US005706792A

United States Patent [19]

Boyer et al.

[11] Patent Number: 5,706,792

[45] Date of Patent: Jan. 13, 1998

[54] INTEGRATED IGNITION COIL AND SPARK PLUG

[75] Inventors: James Alva Boyer, Anderson; Dwayne Allen Huntzinger, Pendleton; Harry Oliver Levers, Jr., Muncie; Albert Anthony Skinner, Anderson; Richard Laurence Haisley, Muncie; Raymond Ora Butler, Jr., Anderson, all of Ind.

[73] Assignee: General Motors Corporation, Detroit, Mich.

[21] Appl. No.: 763,574

[22] Filed: Dec. 10, 1996

[51] Int. Cl.[6] ..... F02P 3/02

[52] U.S. Cl. ..... 123/634; 123/167 PA

[58] Field of Search ..... 123/634, 635, 123/169 PA; 336/65

[56] References Cited

U.S. PATENT DOCUMENTS

| | | | |
|---|---|---|---|
| 1,164,113 | 12/1915 | Orswell | 315/57 |
| 1,302,308 | 4/1919 | Cavanagh | 315/51 |
| 2,441,047 | 5/1948 | Wall | 314/57 |
| 2,459,856 | 5/1949 | Wall | 315/57 |
| 2,467,531 | 4/1949 | Lamphere | 315/57 |
| 2,467,534 | 4/1949 | Osterman | 315/57 |
| 4,514,712 | 4/1985 | McDougal | 336/96 |
| 4,903,674 | 2/1990 | Bassett et al. | 123/634 |
| 5,146,906 | 9/1992 | Agatsuma | 123/634 |
| 5,419,300 | 5/1995 | Maruyama et al. | 123/634 |
| 5,590,637 | 1/1997 | Motodate | 123/634 |

FOREIGN PATENT DOCUMENTS 0716425 12/1995 European Pat. Off. .

*Primary Examiner*—Willis R. Wolfe
*Assistant Examiner*—Hieu T. Vo
*Attorney, Agent, or Firm*—Vincent A. Cichosz

[57] ABSTRACT

A spark plug and ignition coil having concentrically wound primary and secondary coils about a plastic coated iron core are integrated in a dielectric fluid filled assembly characterized by advantageous employment of structurally inherent capacitances for radio frequency attenuation.

8 Claims, 1 Drawing Sheet

INTEGRATED IGNITION COIL AND SPARK PLUG

TECHNICAL FIELD

The present invention is related to internal combustion engine ignition apparatus and more particularly high voltage ignition source hardware.

BACKGROUND OF THE INVENTION

Ignition apparatus for providing a spark to the combustion chamber of an internal combustion chamber engine characterized by a combined spark plug and ignition coil have been proposed in the prior art. For example, U.S. Pat. Nos. 1,164,113 to Orswell, 1,302,308 to Cavanagh, 2,441,047 and 2,459,856 to Wall, 2,467,531 to Lamphere, and 2,467,534 to Osterman all disclose combined ignition coil and spark plugs.

Modern internal combustion engines, particularly those characterized by plural intake and exhaust valve arrangements and overhead cam valve actuation configurations, have very limited space available for providing structurally adequate spark plug wells. Unfortunately for single coil per cylinder spark sources, including combined spark plug and ignition coil apparatus, decreasing spark plug well diameter makes single coil per cylinder ignition systems difficult to successfully implement for a variety of reasons. Among the problems which must be overcome include limited diametrical clearance between the spark plug well and the ignition apparatus, high temperatures especially given the minimal clearances in the limited spark plug wells, and access for installation and removal of the spark plug and ignition coil.

Radio frequency interference (RFI) continues to be a challenge for ignition system designers. Unfortunately for single coil per cylinder spark sources, including combined spark plug and ignition coil apparatus, the nature of such installations do not afford much opportunity for shielding against such RFI. Additionally, each individual ignition source in such distributed single coil per cylinder systems has associated therewith a system voltage line to increasing the ease with which RFI generated by one ignition source may couple in cross talk to the other ignition sources respective system voltage supply lines. Additionally, each supply line may experience substantial direct capacitive coupling of RFI generated by the associated ignition source.

SUMMARY OF THE INVENTION

Therefore, it is an object of the present invention to provide a new integrated spark plug and ignition coil apparatus.

It is preferred that such an apparatus be dimensionable to fit within extremely slender spark plug access wells.

It is further desired that an integrated spark plug and ignition apparatus which can physically be fit within extremely slender spark plug access wells be able to adequately manage the extreme temperature conditions associated with such placement.

Additionally, it is desirable that an integrated spark plug and ignition coil minimize the radiation of RFI to the surroundings.

These and other objects of the invention are provided for in an integrated spark plug and ignition coil apparatus wherein the inherent capacitive and inductive characteristics are advantageously adapted for attenuation of RFI. In accordance with the present invention, a core comprising plastic coated iron particles provides a direct winding surface for a primary coil. The core and primary coil are in turn coaxially surrounded by the secondary coil and a substantially cylindrical outer case formed of magnetic material. Electrical contact is commonly established between the case, the core and vehicle ground. The arrangement establishes a relatively large equivalent capacitance between the primary coil and the core which establishes one leg of an equivalent ladder RFI attenuator with the core coupled to ground. The arrangement also established an equivalent capacitance between the primary coil and the case which establishes another leg of the equivalent ladder RFI attenuator with the case coupled to ground.

In a preferred embodiment of the present invention, an integrated spark plug and ignition coil assembly includes a primary assembly of compacted plastic coated iron particle core upon which is directly wound a primary ignition coil. The primary assembly is surrounded by a secondary coil which itself is surrounded by a case formed from magnetic material. The core and case are both grounded thus eliminating an otherwise substantial capacitively coupled RFI path to B+. The grounding of the case and core further establishes an equivalent ladder attenuation network with the substantial capacitance between the core and the primary coil as one equivalent leg and the capacitance between the case and the secondary coil as another equivalent leg. The apparatus is self contained within the case which is sealed at one end thereof by a sealably disposed connector body and sealed at the other end by the spark plug in communication therewith. A silicone oil fill provides for the necessary degree of heat dissipation and dielectric strength required for close proximity to the high voltage operation of the ignition coils.

BRIEF DESCRIPTION OF THE DRAWINGS

The present invention will now be described, by way of example, with reference to the accompanying drawings, in which.

DESCRIPTION OF THE PREFERRED EMBODIMENT

Figure 1:
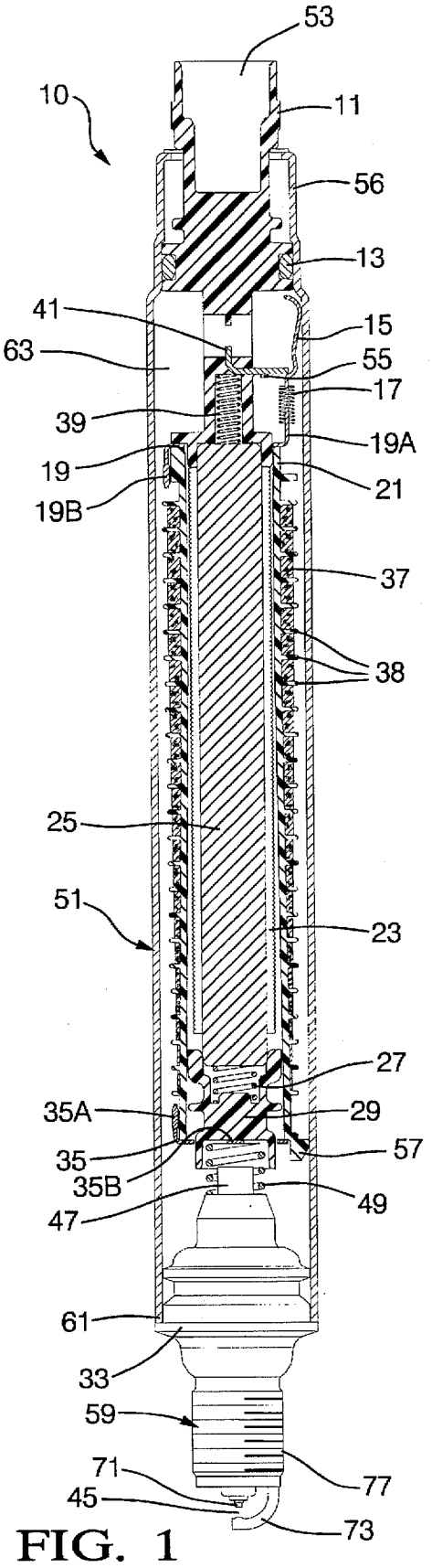
FIG. 1 is a sectional view of a preferred embodiment of an integrated ignition coil and spark plug in accord with the present invention.

Referring to the figures, and particularly to FIG. 1, a preferred embodiment of an integrated ignition coil and spark plug assembly in accordance with the present invention is illustrated in partial sectional view and is generally designated by the reference numeral 10. The integrated ignition coil and spark plug assembly 10 is adapted for installation to a conventional internal combustion engine though a spark plug well and in threaded engagement with a spark plug opening into a combustion cylinder. The assembly has a substantially rigid outer case 51 at one end of which is a spark plug assembly 59 and at the other end of which is a connector body 11 for external electrical interface. The assembly further comprises a substantially slender high voltage transformer including substantially coaxially arranged primary and secondary windings and high permeability magnetic core. All high voltage ignition system components are housed or are part of the integrated ignition coil and spark plug assembly 10.

Generally, the structure is adapted for drop in assembly of components and sub-assemblies as later described.

Secondary spool 21 is formed from an injection molded plastic insulating material having high temperature tolerance such as a polybutylene terephthalate (PBT) thermoplastic polyester for example sold under the trade name Valox® by General Electric. Spool 21 has a plurality of axially spaced ribs 38 forming channels therebetween adjacent ones of the ribs 38. The depth of the respective channels decreases from one end of the spool 21 to the other by way of a progressive gradual flare of the spool body away from the primary coil 23 such that the space between the inner diameter of spool 21 and the primary winding progressively increases from the connector body end to the spark plug end of the assembly. The voltage gradient in the axial direction which increases toward the spark plug end of the secondary coil requires increased dielectric insulation between the secondary and primary coils, and is provided for by way of the progressively increased separation between the secondary and primary and dielectric fluid therebetween as described at a later point. Spacer 29, also preferably a terephthalate (PBT) thermoplastic polyester such as Valox®, and spring 27 are fitted to interior of secondary spool 21 at the end thereof having the shallowest channels between ribs 38. Secondary grounding terminal 19 and secondary negative terminal 35 are hot upset to secure the respective secondary terminals 19,35 to the secondary spool 21. Secondary coil 37 is then wound on the spool between ribs 38 which form winding slots. Coil 37 has more turns in the deeper channels relative to fewer turns in the progressively shallower channels. In the present embodiment, the spool 21 has 23 channels which are wound to fabricate the secondary coil 37. For example, in the exemplary embodiment, secondary coil 37 may be comprised of 24,893 total turns of No. 44 AWG wire, the number of turns in each channel being progressively reduced from the previous channel in accordance with the progressive reduction in channel depths. All 23 channel windings are connected in series by cross-over connections that extend through slots in ribs 38. Such a coil arrangement is generally referred to in the art as a segment wound coil and is generally preferred over conventional layer wound coils for reasons of manufacturing simplicity and decreased capacitance.

The low voltage or ground lead of secondary coil 37 is terminated to tang **19*b* of the secondary grounding terminal 19, and the negative lead of the secondary coil 37 is terminated to tang 35A of secondary negative terminal 35. Both terminal leads of the coil are wrapped and then soldered such as by a hot dip solder operation. Respective tangs 19B, 35A are folded toward one another against the secondary spool 21 to lie substantially axially against or in proximity to the spool 21**.

The core 25 is manufactured from plastic coated iron particles in a compression molding operation. The iron particles are carried by a binder of electrical insulating material. The iron particles may have a mean particle size of about 0.004 inches. In production of a part, the iron particles are coated with a liquid thermoplastic material which encapsulates the individual particles. The coated iron particles are placed in a heated mold press where the composite material is compressed to the desired shape and density. The final molded part is then comprised of iron particles in a binder of cured thermoplastic material. By way of example, the final molded part may be, by weight, about 99% iron particles and 1% plastic material. By volume, the part may be about 96% iron particles and 4% plastic material. Because of the elongated shape of the core 25, the type of compression molding process utilized applies primary compressive forces normal to the major axis of the piece to provide uniform compaction throughout. Such core fabrication is generally preferred since cost effective round cross section cores may be produced thereby. After the core 25 is molded, it is finish machined such as by grinding to provide a smooth surface absent for example sharp mold parting lines otherwise detrimental to the intended direct primary coil winding thereon. The primary coil 23 is wound directly on the surface of the molded core 25. The windings are formed from insulated wire which are wound directly upon the outer cylindrical surface of the core 25. The primary coil 23 may be comprised of two winding layers each being comprised of 127 turns of No. 23 AWG wire. Adhesive coatings, though not foreseeably needed, may be applied to the primary coil such as by conventional felt dispenser during the winding process or by way of a partially cured epoxy coat on the wire which is heat cured after winding. The winding of the primary coil directly upon the core provides for efficient heat transfer of the primary resistive losses and improved magnetic coupling which is known to vary substantially inversely proportionally with the volume between the primary winding and the core.

The connector body 11 is also preferably molded from Valox® however in a conventional insert molding process to capture the core grounding terminal 41 and a pair of primary terminals (not shown). The core grounding terminal 41 has a portion thereof exposed at the base of an axial cavity 55 at the interior end portion of connector body 11. The primary terminals extend into the connector well 53 for coupling to the primary energization circuitry external to the integrated ignition coils and spark plug. Radially yieldable connector 15 is crimped to core grounding terminal 41 allowing for a terminal tail portion to be extensibly disposed therefrom. The core grounding spring 39 is assembled into the cavity at the interior end portion of connector body 11. The core 25 is assembled to the interior end portion of the connector body compressing core grounding spring 39 to establish positive electrical contact between the core 25 and the core grounding terminal 41. The terminal leads (not shown) of primary coil 23 are connected to the insert molded primary terminals by soldering.

The primary sub-assembly is next inserted into the secondary spool 21 with a slight interference fit of the outer surface of the interior end portion of the connector body to the interior surface of the secondary spool. Spring jumper 17 flexibly connects tang 19A of secondary grounding terminal 19 to the terminal tail portion extensibly disposed from core grounding terminal 41.

Case 51 is formed from round tube stock preferably comprising nickel plated 1008 steel or other adequate magnetic material. Where higher strength may be required, such as for example in unusually long cases, a higher carbon steel or a magnetic stainless steel may be substituted. A portion of the case 51 at the end adjacent the connector body 11 is preferably formed by a conventional swage operation to provide a plurality of flat surfaces to provide a fastening head, such as a hexagonal fastening head 56 for engagement with standard sized drive tools. Additionally, the extreme end is rolled inward to provide necessary strength for torques applied to the fastening head 56 and to provide a shelf for trapping ring clip 43 between the case 51 and the connector body 11. The previously assembled primary and secondary sub-assemblies are loaded into the case 51 from the spark plug end to a positive stop provided by the swaged end acting on a portion of the connector body 11. Additionally, a plurality of radially extending spacers 57 provide for substantial centering and limited range of radial motion of the primary and secondary sub-assembly within case 51.

The entire assembly is then filled with a predetermined volume of fluidic dielectric suitable for the high temperature and high voltage environment of the integrated ignition coil and spark plug assembly. A general category of Polydimethyl siloxane oils have demonstrated dielectric properties, volume resistivity properties and heat dissipation properties considered to be adequate for automotive engine applications. For example, one such commercially available fluid is identified as SF97-50 silicone dielectric fluid available from General Electric Corporation. Another such commercially available fluid includes 561™ fluid marketed by Dow Corning. The volume of fluid fill is sufficient to completely submerge the secondary assembly when the integrated ignition coil and spark plug is in a normally installed position. A volume between the connector body 11 just below the O-ring 13 and the top of the secondary assembly provides an expansion chamber 63 for volumes of fluid displaced during the normal course of thermal expansions of the components and the effective volume changes of the secondary and primary subassembly. After fluid fill, ring clip 43 is installed to prevent the primary and secondary assembly from being pulled back though the case opening.

Next, the spark plug assembly 59 is installed to close the end of the case 51 opposite the connector body 11. Spark plug assembly includes a conductive outer shell 33 surrounding a ceramic spark plug insulator 31 through which axially passes the high voltage center electrode 47 (hereafter negative electrode) including RFI suppression resistor (not shown). Conductive outer shell 33 tapers down to a threaded portion 77 which threadably engages into the combustion cylinder head. Extending from the bottom of threaded portion 77 and over center of an exposed portion 71 of negative electrode 47 is the complementary ground electrode 73. Ionization gap 45 is thereby established between respective negative and ground electrodes 47 and 73. Surrounding an exposed portion of the negative electrode 47 and in electrical contact therewith is high voltage contact spring 49. The distal end of high voltage contact spring 49 is engaged with a recessed portion of spacer 29. An interior tang 35B integral with secondary negative terminal 35 is in electrical contact with contact spring 49 to thereby couple the high voltage output of the secondary coil 37 to the electrode 47. A weld seam 61 runs the entire perimeter between the end of the case 51 and the conductive housing 33 of spark plug assembly 59 such as by a conventional resistance welding process thus completing the assembly steps and providing a structural, electrical and hermetically sealed joint..

Figure 2:
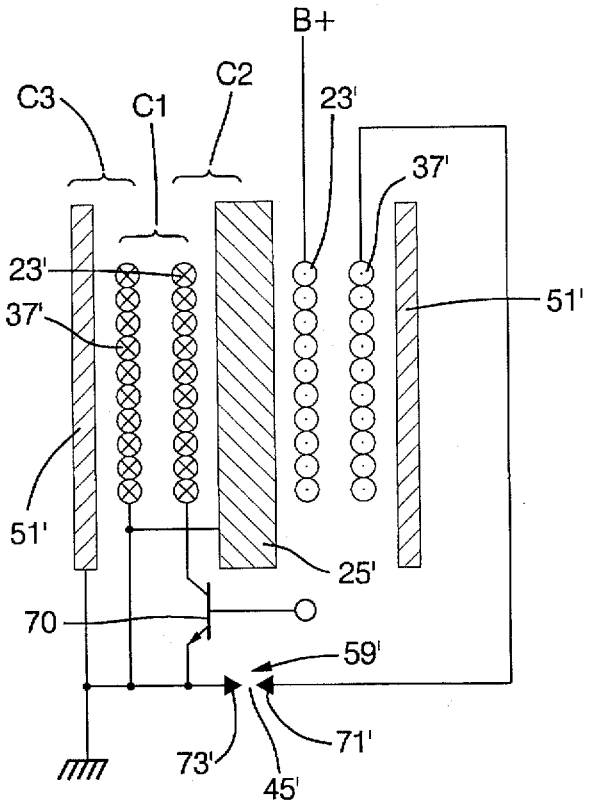
FIG. 2 is a simplified mechanical and electrical schematic illustration of the an integrated ignition coil and spark plug in accord with the present invention; and, FIG. 3 represents an equivalent electrical circuit of an integrated ignition coil and spark plug in accord with the present invention.
Figure 3:
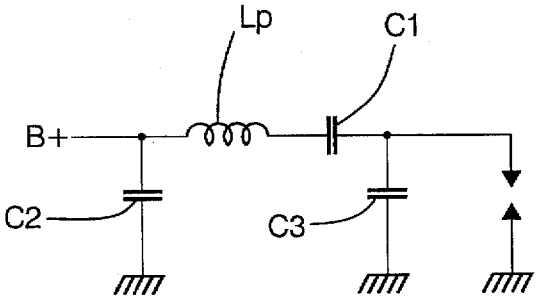

With reference now to FIGS. 2 and 3, the embodiment of the invention illustrated with particularity in FIG. 1 is shown in simplified schematic form wherein certain of the electrical and magnetic circuit elements are labeled with primed designations of corresponding features of FIG. 1. The core 25' is shown surrounded in progressive coaxial fashion by primary coil 23', secondary coil 37' and case 51'. One lead of the primary coil 23' is seen to be coupled to system voltage labeled B+ in the riffle. The B+ coupling would be by way of an external connection provided by the connector body at one end of the assembly. The other lead of the primary coil 23' is selectively coupled to vehicle ground by way of a controllable semi-conductor switch 70. Switch 70 is controlled in a well known manner in accordance with predetermined ignition timing objectives for each cylinder by a conventional spark timing module in response to sensed angles of engine rotation as generally well known in the art. The core 25' and the primary coil 23' capacitively couple one with the other, the equivalent capacitance being labeled C2 in the figures. The equivalent capacitance C2 is relatively large due in great part to the proximity of the core 25' and the primary coil 23'. One lead of secondary coil 37' is directly coupled to the exposed portion 71' of the negative electrode of the spark plug assembly. The other electrode 73' of the spark plug assembly 59' is directly coupled to vehicle ground. The secondary coil 37' and the primary coil 23' capacitively couple one with the other, the equivalent capacitance being labeled C1 in the figures. The case 51' is of course enclosing the core 25', and the primary and secondary coils, 23' and 37' respectively.

In accordance with the invention, the case 51' is directly coupled to the vehicle ground by way of the threaded portion of the spark plug. The core 25' is also in accordance with the present invention directly coupled to vehicle ground through the case as described in accordance with the embodiment illustrated in FIG. 1. The case 51' and the secondary coil 37' capacitively couple one with the other, the equivalent capacitance being labeled C3 in the figures. Attenuation of RFI generated by the sparking event of the spark plug is advantageously provided by a ladder type RFI filter modeled by a simplified equivalent circuit in FIG. 3. As indicated, the proximity of the primary winding afforded by the direct winding thereof on the core provides a relatively large equivalent capacitance C2. The grounding of the case establishes an equivalent capacitance C3 between vehicle ground and the secondary winding on one side of the equivalent primary inductance $L_p$. The grounding of the core establishes an equivalent capacitance C2 between vehicle ground and the other side of the equivalent primary inductance $L_p$. RFI otherwise capacitively coupled in parallel across the equivalent primary inductance $L_p$, especially because of the inherently large capacitive effects of winding the primary coil directly upon the core, is instead attenuated by the equivalent ladder network thus greatly reducing the direct coupling to the supply voltage B+.

While the present invention has been described with respect to certain preferred embodiments and alternatives, it is anticipated that certain other alternatives may become apparent to those exercising ordinary skill in the art. Therefore, the preceding descriptions are intended to be taken by way of non-limiting example, the invention being limited only by the claims as appearing hereafter.

We claim:

1. An integrated spark plug and ignition coil apparatus comprising:

a magnetic core having opposite first and second ends;

a primary coil wound about the core between the first and second ends;

a secondary coil assembly including a spool and secondary coil wound thereon, said secondary coil assembly surrounding said primary coil and magnetic core, said secondary coil having a ground lead and a negative lead;

a spark plug assembly having a negative electrode connected to the ground lead of the secondary coil and an electrically conductive outer shell including a threaded portion for engagement with a combustion cylinder head and a ground electrode;

a magnetic case disposed about said magnetic core, primary coil and secondary coil assembly, said magnetic case fixably joined at one end thereof to said electrically conductive outer shell of said spark plug assembly; and said magnetic core and ground lead of the secondary coil being adapted for electrical connection to the magnetic case.

2. An integrated spark plug and ignition coil apparatus as claimed in claim 1 further comprising:

a predetermined volume of dielectric fluid contained the magnetic case sufficient to substantially submerge the magnetic core, primary coil and secondary assembly.

3. An integrated spark plug and ignition coil apparatus as claimed in claim 1 wherein said magnetic case is formed at the other end thereof opposite the spark plug assembly with a plurality of circumferentially disposed flat surfaces adapted for engagement with a tool for transmitting torque to the magnetic case.

4. An integrated spark plug and ignition coil apparatus as claimed in claim 1 wherein said magnetic case is fixably joined to said electrically conductive outer shell of said spark plug assembly by a continuous weld.

5. An integrated spark plug and ignition coil apparatus comprising:

a coil assembly including a magnetic core formed from a composite magnetic material of iron particles in a binder of electrical insulating material having a substantially cylindrical outer surface and concentrically wound primary and secondary coils, said primary coil being formed directly upon the outer surface of said magnetic core and separated from said secondary coil by an insulating spool;

a substantially cylindrical housing having axially opposite first and second ends formed from magnetic material in concentric spaced adjacency with said coil assembly such that said coil assembly is axially intermediate said first and second ends;

said magnetic core and ground lead of the secondary coil being adapted for electrical connection to the housing;

a spark plug assembly including a negative electrode separated from a conductive outer shell by an insulator, said outer shell being adapted for threaded engagement with a combustion cylinder head and forming a ground electrode to establish an ionization gap with said negative electrode;

said outer shell sealably coupled to one of said axially opposite first and second ends of said housing to provide mechanical and electrical union therebetween, the other of said axially opposite first and second ends of said housing being sealably coupled to a connector body adapted for interfacing said primary coil to external energization circuitry; and a predetermined volume of dielectric fluid contained the cylindrical housing between the axially opposite first and second ends thereof sufficient to substantially submerge the coil assembly.

6. An integrated spark plug and ignition coil apparatus as claimed in claim 5 wherein said housing is formed at the end thereof opposite the spark plug assembly with a plurality of circumferentially disposed flat surfaces adapted for engagement with a tool for transmitting torque to the housing.

7. An integrated spark plug and ignition coil apparatus comprising:

a spark plug assembly including a central negative electrode progressively surrounded by a ceramic insulator and a conductive outer shell, said conductive outer shell including a ground electrode extending from a threaded portion adapted for engagement to a combustion cylinder head;

a substantially cylindrical case formed from magnetic material having first and second ends, said case welded to the conductive outer shell of said spark plug assembly at the first end and fixably and sealably engaged to a connector body;

an ignition coil assembly including a primary coil wound directly upon a magnetic core formed from composite magnetic material of iron particles in a binder of electrical insulating material, and a secondary coil wound concentrically in segments about the primary coil and separated therefrom by an insulative spool, said ignition coil assembly concentrically disposed within said case in spaced adjacency therefrom and fixably engaged at one end thereof to the connector body and axially yieldably engaged at the other end thereof to the spark plug assembly; and a volume of dielectric fluid contained within the confines of the case, spark plug assembly and connector body substantially covering the ignition coil assembly.

8. An integrated spark plug and ignition coil apparatus as claimed in claim 7 further comprising a plurality of circumferentially disposed flat surfaces formed on said case at the end thereof adjacent the connector body adapted for engagement with a tool for transmitting torque to the case.

* * * * *